US006156135A

United States Patent [19]

Hotta et al.

[11] Patent Number: 6,156,135

[45] Date of Patent: Dec. 5, 2000

[54] ALUMINUM SUBSTRATE FOR LITHOGRAPHIC PRINTING PLATE AND PROCESS FOR PRODUCING THE SAME

[75] Inventors: Yoshinori Hotta; Hirokazu Sawada; Hirokazu Sakaki, all of Shizuoka, Japan

[73] Assignee: Fuji Photo Film Co., Ltd., Minami-Ashigara, Japan

[21] Appl. No.: 09/041,300

[22] Filed: Mar. 12, 1998

[30] Foreign Application Priority Data

Mar. 14, 1997 [JP] Japan ..... 9-061247

[51] Int. Cl.[7] ..... B41N 3/00; C22F 1/04

[52] U.S. Cl. ..... 148/551; 148/552; 148/692; 148/437; 101/459

[58] Field of Search ..... 101/459; 148/551, 148/552, 692, 437

[56] References Cited

U.S. PATENT DOCUMENTS 5,078,805 1/1992 Uesugi et al. .
5,350,010 9/1994 Sawada et al. .
5,456,772 10/1995 Matsuki et al. .
5,462,614 10/1995 Sawada et al. .
5,507,887 4/1996 Uesugi et al. .
5,525,168 6/1996 Sawada et al. .
5,711,827 1/1998 Sawada et al. .

FOREIGN PATENT DOCUMENTS 730979 9/1996 European Pat. Off. .

*Primary Examiner*—George Wyszomierski
*Assistant Examiner*—Janelle Morillo
*Attorney, Agent, or Firm*—Burns, Doane, Swecker & Mathis, LLP

[57] ABSTRACT

An aluminum substrate for lithographic printing plates which forms uniform pits on electrolytic etching without undergoing dissolution, the substrate being obtained by electrolytic etching an aluminum plate prepared by continuous casting in a twin roll mold process, rolling, and annealing, in which the annealing is carried out in such a manner that the resulting aluminum plate may have a total electric current density of not more than $1.85\times10^{-2}$ C/dm$^2$ when scanned at a potential from −100 mV up to 1500 mV.

4 Claims, 3 Drawing Sheets

ALUMINUM SUBSTRATE FOR LITHOGRAPHIC PRINTING PLATE AND PROCESS FOR PRODUCING THE SAME

FIELD OF THE INVENTION

This invention relates to an aluminum substrate for lithographic printing plates and a process for producing the same. It particularly relates to an aluminum substrate obtained by at least electrolytic etching a plate material which is prepared by a twin-roll continuous casting and direct hot rolling process and then annealing, and a process for producing the same.

BACKGROUND OF THE INVENTION

In the field of lithographic printing plate making, an aluminum plate obtained by a direct chill (DC) casting process has enjoyed wide use as a material of a substrate. In recent years, it has been proposed to use an aluminum plate obtained by a twin-roll continuous casting and direct hot rolling process that is simpler than DC casting (hereinafter simply referred to as a hot rolled plate). For example, U.S. Pat. No. 5,078,805 which corresponds to JP-A-3-79798 (the term "JP-A" as used herein means an "unexamined published Japanese patent application") discloses a process for producing an aluminum substrate for a lithographic printing plate, in which an aluminum plate is obtained by continuous casting and direct hot rolling according to the twin-roll method. Manipulations proposed in making use of the hot rolled aluminum plate include the apparatus disclosed in U.S. Pat. No. 5,462,614 which corresponds to JP-A-6-262308 and the process conditions disclosed in EP 0730979 A2 which corresponds to JP-A-8-238860.

However, when a hot rolled aluminum plate is electrolytically etched as is common in the art, the surface tends to dissolve, resulting in formation of a different surface profile from that of conventional plate materials with the electrolytic etching conditions being equal. As a result, the resulting printing plate tends to have inferior appearance or printing performance. It has therefore been demanded to establish conditions for a continuously cast aluminum material to be electrolytically etched without undergoing surface dissolution.

SUMMARY OF THE INVENTION

An object of the present invention is to provide a continuously cast aluminum plate which forms uniform surface roughness when electrolytically etched without undergoing dissolution.

The inventors of the present invention have extensively studied what conditions should be imposed in the production of a hot rolled aluminum plate in order for the resulting aluminum plate to form uniform surface roughness in electrolytic etching. As a result, we have found that an aluminum material which has been annealed under selected conditions prior to electrolytic etching so as to gain specific electrochemical characteristics forms uniform pits on its surface when electrolytically etched. The present invention has been completed based on this finding.

The present invention relates to an aluminum substrate for lithographic printing plates which is obtained by electrolytic etching an aluminum plate prepared by continuous casting in a twin roll method, rolling, and annealing, wherein the aluminum plate has such surface electrochemical characteristics that a total electric current is not more than $1.85\times10^{-2}$ C/dm$^2$ when it is scanned at a potential from −100 mV up to 1500 mV.

The present invention also relates to a process for producing an aluminum substrate for lithographic printing plates which comprises electrolytic etching an aluminum plate prepared by continuous casting in a twin-roll method, rolling, and annealing, in which the annealing is carried out in such a manner that the resulting aluminum plate may have a total electric current density of not more than $1.85\times10^{-2}$ C/dm$^2$ when scanned at a potential from −100 mV up to 1500 mV.

DETAILED DESCRIPTION OF THE INVENTION

Aluminum that can be used as a raw material in the present invention includes pure aluminum and various aluminum alloys, such as alloys with a silicon alloy, a copper alloy, a manganese alloy, a magnesium alloy, a chromium alloy, a zinc alloy, a lead alloy, a nickel alloy, and a bismuth alloy.

The aluminum plate used in the present invention is a plate obtained from molten aluminum by twin-roll continuous casting and direct hot rolling, i.e., a hot rolled thin aluminum plate in a coil that is obtained from molten aluminum by continuous casting and direct hot rolling. Compared with conventional processes, the continuous casting and direct hot rolling process is advantageous in that generation and incorporation of oxides are minimized and that surface grinding is not necessary, thereby achieving reduction in both initial cost and running cost.

Figure 1:
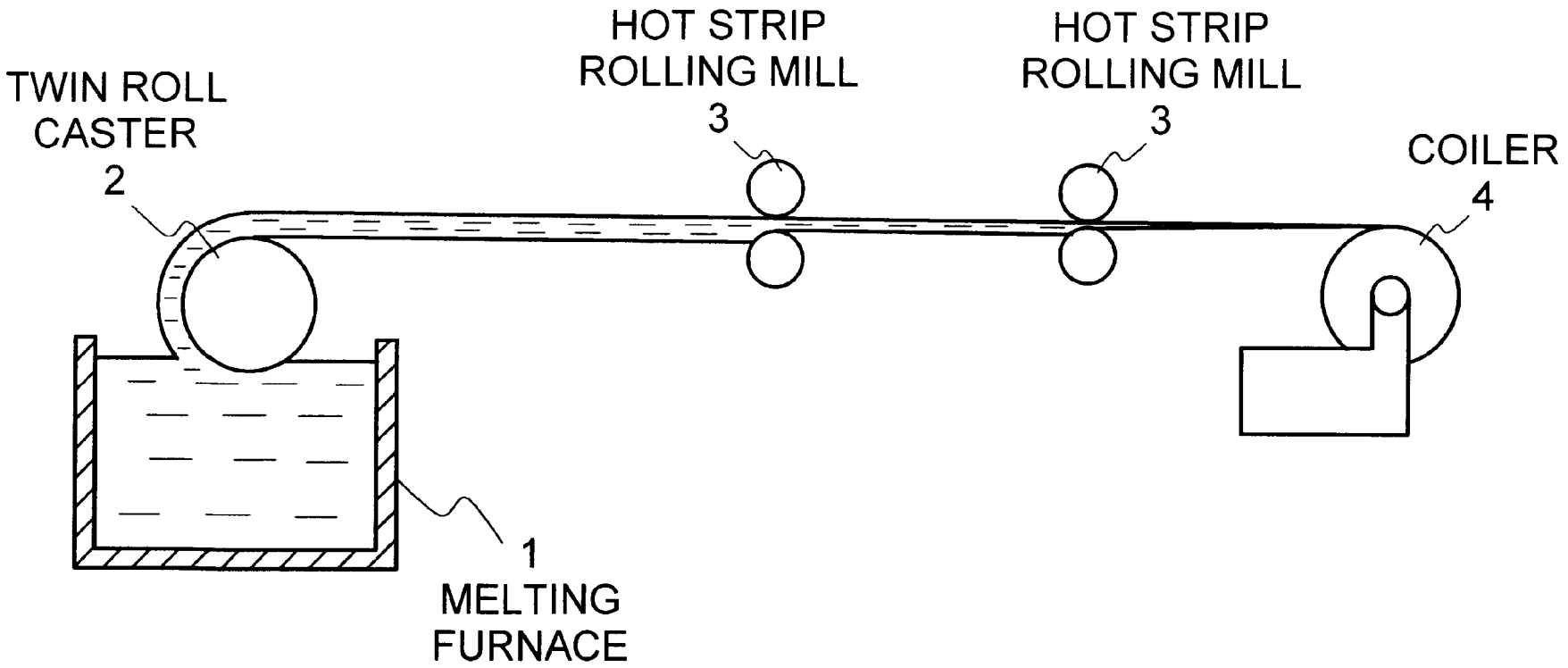
FIG. 1 is a schematic illustration of an apparatus for carrying out a twin roll continuous casting and direct hot rolling process for producing an aluminum plate used in the present invention.

Production of the aluminum plate of the present invention is shown in FIG. 1. An aluminum ingot is melted and maintained in a molten state in a melting furnace 1. The molten aluminum is picked up on a twin roll caster 2, send to a hot strip rolling 3, and taken up around a coiler 4. That is, a coil of a continuous hot rolled thin plate is directly obtained from molten aluminum.

The aluminum in the melting furnace 1 should be maintained at a temperature above the melting point, generally 800° C. or higher, while appropriately decided according to the composition of aluminum alloy.

Containing non-metallic inclusions, such as oxides, and alkali metals, such as sodium, the molten aluminum must be cleaned usually by a flux method or $Cl_2$ bubbling. Hexachloroethane is most frequently used as a flux.

Casting is roughly divided into a movable casting system and a fixed casting system. Most of the currently operated processes are movable casting systems, such as a Hunter process, a 3C process, and a Hazellett process. The casting temperature is most suitably around 700° C., while varying between a movable casting system and a fixed casting system. The resulting slab usually having a thickness of 100 to 300 mm is continuously subjected to hot rolling.

The hot strip rolling mill 3 is composed of a rough rolling mill and a finish rolling mill. The slab is made into a 10 to 50 mm thick strip through the hot strip rolling mill 3 and taken up on the coiler 4. Of the hot rolling conditions, temperature particularly has an influence on electrolytic graininess of the resulting substrate. It suitably ranges from 350° C. to 550° C.

The thus obtained aluminum coil (aluminum material) is subjected to cold rolling to a prescribed thickness (e.g., 2 mm) and then annealed so that the finally obtained plate surface may have the above-specified electrochemical characteristics, that is, the resulting aluminum plate may have a total electric current of not more than $1.85\times10^{-2}$ C/dm$^2$ when scanned with a potential from −100 mV to 1500 mV. While varying depending on material, the optimum annealing temperature is about 500° C. to 650° C. for JIS 1050 alloys.

Figure 2:
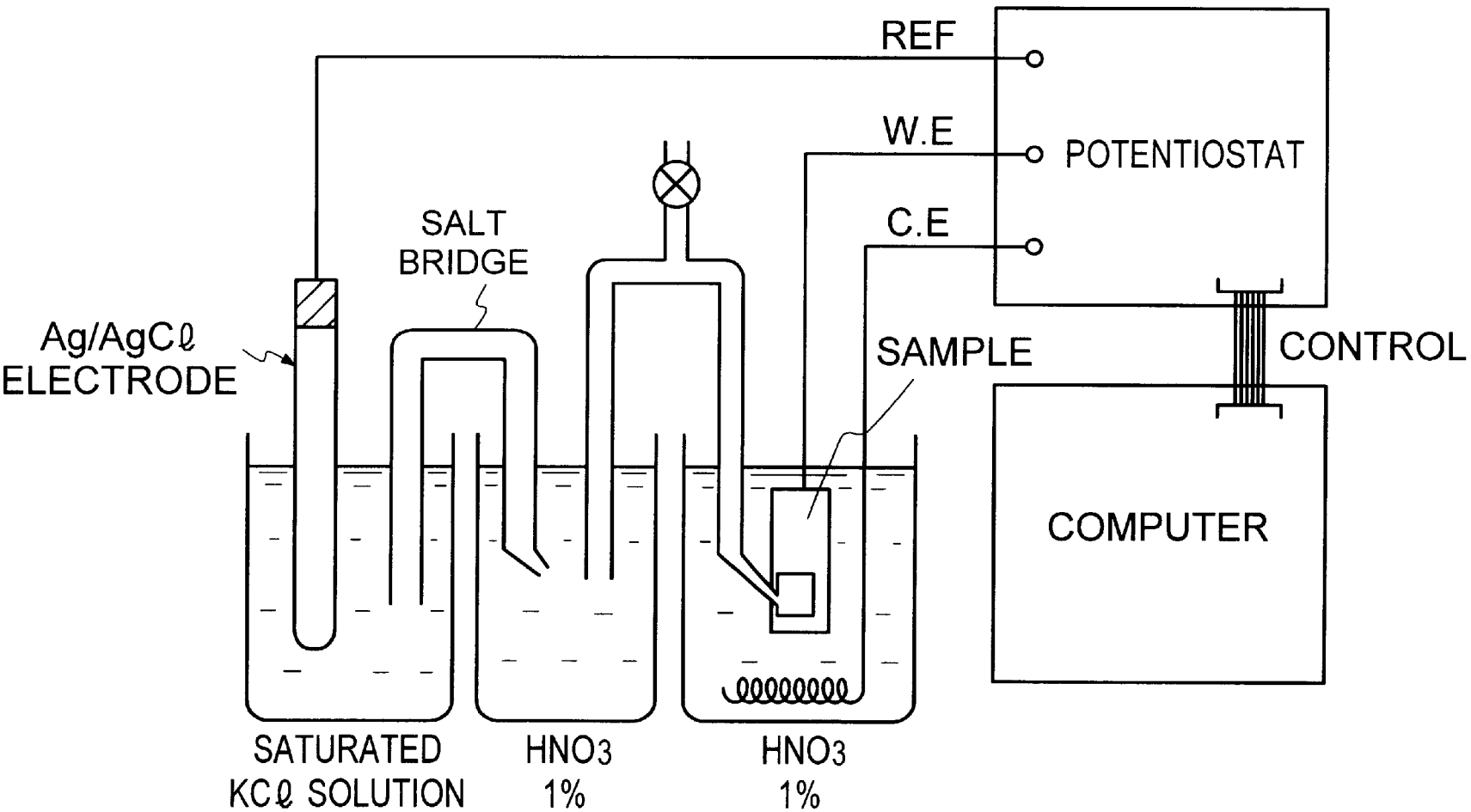
FIG. 2 is a measuring system containing an electrometric circuit for measuring the electrochemical characteristics of the surface of an annealed aluminum plate.

In the present invention, the electrochemical characteristics of the surface of the annealed aluminum material can be determined by use of the measuring system having the electrometric circuit shown in FIG. 2. The system comprises a reaction cell containing an electrolytic solution in which an aluminum plate sample and a counter electrode are immersed, a reference cell containing a saturated KCl solution in which an Ag/AgCl electrode is immersed, and a potentiostat to which each electrode is connected. The potential of the aluminum surface was maintained constant with reference to the Ag/AgCl electrode by means of the potentiostat for measuring the current flowing in the aluminum plate. The cells are usually connected via a salt bridge taking care not to cause a current leak.

Figure 3:
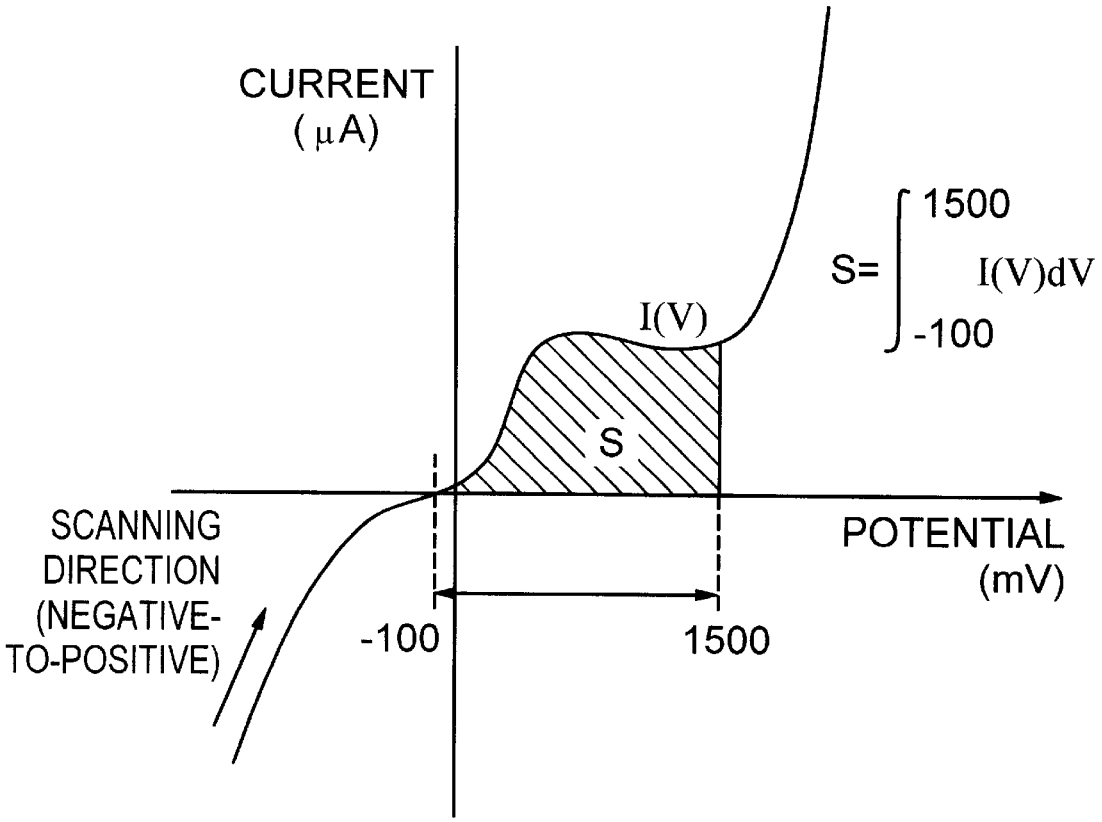
FIG. 3 is a voltamogram obtained by electrometry with the measuring system of FIG. 2.

The aluminum surface is scanned at a potential in a negative to positive direction, and the changes in current are recorded to obtain a voltamogram as shown in FIG. 3.

In the embodiment depicted in FIGS. 2 and 3, the voltamogram was obtained while controlling the potentiostat on a computer. The measurement was made in a 1% nitric acid electrolytic solution kept still and at 30° C. while scanning from −100 mV to 2000 mV at a rate of potential increase of 1 V/sec. The results obtained are shown in FIG. 3. In general, a voltamogram prepared in this way displays a passive state when the potential is converted to negative to positive, in which the current shows no change with an increasing potential. As the sample is further scanned with a potential to the positive direction, the voltamogram shows an aluminum dissolution area accompanied by evolution of gas, in which a large current flows.

The passive state seems attributed to material characteristics, and the oxide film formed on the aluminum surface is said to have influences on the reactivity during electrolytic surface graining (see Aluminum Handbook).

The area indicated by slanted lines in the voltamogram of FIG. 3 is calculated by integration to obtain a total current S as defined in the present invention.

Once annealing conditions which provide an aluminum material whose surface has the above-specified electrochemical characteristics are established through experiments, annealing for an aluminum plate of the same composition and the same size can be carried out under the these conditions.

After annealing, the aluminum plate is successively subjected to rolling, surface graining and other necessary treatments to obtain an aluminum substrate for a lithographic printing plate.

Surface graining is carried out by electrochemical graining, i.e., electrolytic etching. If desired, electrolytic etching may be combined with mechanical graining or chemical graining.

Mechanical graining includes ball graining, wire graining, brush graining, and hydro-horning. Electrochemical graining is generally effected by alternating current (AC) electrolytic etching. An ordinary sinusoidal alternating current or a special alternating current, such as a rectangular wave current, is used. If desired, the electrochemical surface graining may be preceded by alkali etching with caustic soda, etc.

In more detail, surface graining of the aluminum material whose surface has been endowed with the specific electrochemical characteristics can be carried out as follows.

The aluminum material is usually subjected to alkali etching as a pretreatment. Suitable alkali agents include sodium hydroxide, potassium hydroxide, sodium metasilicate, sodium carbonate, sodium aluminate, and sodium gluconate. The alkali etching is suitably carried out with an etching solution having an alkali concentration of 0.01 to 20% by weight at a temperature of 20 to 90° C. for a period of 5 seconds to 5 minutes. A preferred amount of aluminum to be dissolved by alkali etching is 0.1 to 15 g/m$^2$.

If necessary, the alkali-etched aluminum plate can be desmutted to remove alkali-insoluble matter (smut) from the surface.

The thus pretreated aluminum plate is AC electrolytically etched in an electrolytic solution mainly comprising hydrochloric acid or nitric acid. The frequency of the AC electrolytic current is 0.001 to 100 Hz, preferably 0.1 to 1.0 Hz or 10 to 60 Hz.

The electrolytic solution has an electrolyte concentration of 3 to 150 g/l, preferably 5 to 50 g/l. The amount of dissolved aluminum in the electrolytic cell is suitably not more than 50 g/l and preferably 2 to 20 g/l. The electrolytic solution may contain additives if desired, but addition of additives makes concentration control difficult in mass production.

The current density suitably ranges from 5 to 100 A/dm$^2$, particularly 10 to 80 A/dm$^2$. The wave form of a power source to be used is selected appropriately according to the desired quality and the components of the aluminum plate. It is preferable to use the special alternating wave form described in JP-B-56-19280 and JP-B-55-19191 (the term "JP-B" as used herein means an "examined Japanese patent publication"). The wave form and the conditions of the electrolytic solution are selected appropriately according to the quantity of electricity as well as the desired quality and the components of the aluminum material.

Since the surface of the aluminum plate to be electrolytically etched (surface grained) of the present invention has been endowed with the above-specified electrochemical characteristics by annealing, it forms uniform pits on electrolytic etching without surface dissolving.

The electrolytically etched aluminum plate is immersed in an alkali solution, such as a sodium hydroxide aqueous solution, to remove the smut. The desmutting treatment with the alkali is preferably carried out at a pH of 10 or higher and at a temperature of 25 to 60° C. for a very short time of 1 to 10 seconds. The aluminum plate is then immersed in a solution mainly comprising sulfuric acid. This desmutting treatment is preferably conducted at a sulfuric acid concentration considerably lower than in a conventional treatment, e.g., 50 to 400 g/l at a temperature of 25 to 65° C. Treatment at sulfuric acid concentrations of 400 g/l or higher or at temperatures exceeding 65° C. can cause large corrosion of the treated layer and, in the case of an aluminum alloy having a manganese content of 0.3% or more, can eat away the surface roughness formed by the electrochemical graining. The amount of aluminum material to be dissolved by etching is preferably not more than 0.2 g/m$^2$. Otherwise the resulting printing plate can have reduced printing durability.

The desmutted aluminum plate is usually anodized to form an anodized layer preferably to a depth of 0.1 to 10 g/m$^2$, still preferably to a depth of 0.3 to 5 g/m$^2$. Anodizing conditions are subject to variation depending on the electrolytic solution used. In general, the electrolytic solution has a concentration of 1 to 80% by weight and a temperature of 5 to 70° C., and the electrolysis is suitably carried out at a current density of 0.5 to 60 A/cm$^2$, a voltage of 1 to 100 V for 1 second to 5 minutes.

Stable and excellent in hydrophilic properties, the grained aluminum substrate having an anodized layer can have a photosensitive layer formed directly thereon. If desired, an additional surface treatment may be given to the aluminum substrate prior to the formation of a photosensitive layer. For example, a silicate layer comprising an alkali metal silicate or an undercoating layer comprising a hydrophilic polymer compound can be provided. The undercoating layer preferably has a coating weight of 5 to 150 mg/m$^2$. Finally, a photosensitive layer is formed on the resulting aluminum substrate to provide a lithographic printing plate.

According to the present invention, by the use of a hot rolled material having specific electrochemical surface characteristics, an aluminum substrate for a lithographic printing plate which has a satisfactory grained surface profile can be obtained under the same graining conditions as have been adopted for conventional DC cast materials. Besides, the use of hot rolled material cuts down the production cost.

The present invention will now be illustrated in greater detail with reference to Example, but it should be understood that the present invention is not deemed to be limited thereto.

EXAMPLE 1

A molten aluminum alloy (JIS 1050) was continuously cast and rolled by a twin-roll continuous casting and direct hot rolling process (a Hunter process) as shown in FIG. 1 into a 6 to 10 mm thick aluminum plate, which was taken up in coil. The aluminum plate was cold rolled and then annealed under the conditions shown in Table 1 below to obtain a rolled plate having a thickness of 0.24 mm and a strength H18.

The rolled aluminum plate was degreased with a sodium hydroxide aqueous solution, followed by desmutting by immersion in 20% sulfuric acid. The electrochemical characteristics of the resulting plate were measured by use of the electrometric circuit shown in FIG. 2 to prepare a voltamogram, from which the total current S between −100 and 1500 mV/Ag/AgCl was calculated.

The surface of the rolled plate was mechanically grained with a nylon brush and an aqueous slurry of abrasive grains, degreased with a sodium hydroxide aqueous solution, subsequently subjected to electrolytic etching in an electrolytic solution containing 10 g/l of nitric acid by applying an alternating current of 60 Hz to a quantity of electricity of 200 C/dm$^2$ at the anode. After desmutting, the surface profile of the etched aluminum plate was observed under an electron microscope. The appearance of the plate also evaluated by visual inspection. The results obtained are shown in Table 1 along with the casting process the annealing conditions.

TABLE 1

| Run No. | Casting Process | Annealing Conditions Temp. (° C.) | Annealing Conditions Time (hrs.) | Total Current S ($\times 10^{-2}$ C/dm$^2$) | Grained Surface Profile | Appearance | Production Cost | Remark |
|---|---|---|---|---|---|---|---|---|
| 1 | continuous casting | 600 | 0.2 | 1.72 | very good | good | low | Invention |
| 2 | continuous casting | 600 | 2 | 1.62 | very good | very good | " | " |
| 3 | continuous casting | 550 | 2 | 1.83 | good | medium | " | " |
| 4 | continuous casting | 480 | 2 | 1.89 | bad* | bad | " | Comparison |
| 5 | continuous casting | 400 | 2 | 2.09 | bad* | bad | " | " |
| 6 | continuous | 400 | 10 | 2.04 | bad* | bad | " | " |
| A | DC casting | (500) | (CAL) | 1.69 | very good | very good | high | " |
| B | DC casting | undone | | 1.99 | bad* | bad | " | " |
| C | DC casting | (500) | (CAL) | 2.16 | very good | very good | " | " |

Note: *The surface underwent dissolution.

As is apparent from the results in Table 1, the aluminum substrates obtained by the twin-roll continuous casting and direct hot rolling process whose surface electrochemical characteristics fall within the specific range (S=1.85×10$^{-2}$ C/dm$^2$ or less) are superior in surface profile and appearance of the grained surface to the comparative substrates having the same alloy composition but the total current S of higher than 1.85×10$^{-2}$ C/dm$^2$.

Of the samples A, B and C which were prepared by DC casting process, sample C exhibits excellent surface profile and appearance although the total current S is more than 1.85×10$^{-2}$ C/dm$^2$. However, these samples inclusive sample C involve considerably high production cost arising from their casting process.

While the invention has been described in detail and with reference to specific examples thereof, it will be apparent to one skilled in the art that various changes and modifications can be made therein without departing from the spirit and scope thereof.

What is claimed is:

1. An aluminum substrate for lithographic printing plates which is obtained by electrolytic etching an aluminum plate prepared by continuous casting in a twin roll method, rolling, and annealing, said aluminum plate having such surface electrochemical characteristics that a total electric current is not more than $1.85\times10^{-2}$ C/dm$^2$ when it is scanned at a potential from −100 mV up to 1500 mV.

2. A process for producing an aluminum substrate for lithographic printing plates which comprises electrolytic etching an aluminum plate prepared by continuous casting in a twin roll method, rolling, and annealing, in which said annealing is carried out in such a manner that the resulting aluminum plate has a total electric current of not more than $1.85\times10^{-2}$ C/dm$^2$ when scanned at a potential from −100 mV up to 1500 mV.

3. A process for producing an aluminum substrate for lithographic printing plates according to claim 2, wherein said annealing is carried out under the condition of annealing temperature from 500° C. to 650° C. and annealing time from 0.2 hour to 2 hours.

4. A process for producing an aluminum substrate for lithographic printing plates according to claim 2, wherein said annealing is carried out under the condition of annealing temperature from 550° C. to 600° C. and annealing time from 0.2 hour to 2 hours.

* * * * *